US007377384B2

(12) United States Patent
Mitten et al.

(10) Patent No.: US 7,377,384 B2
(45) Date of Patent: May 27, 2008

(54) CIGARETTE PACK COMPRISING TWIN CIGARETTE PACKETS

(75) Inventors: Robert T. Mitten, Glen Allen, VA (US); Scott A. Fath, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 496 days.

(21) Appl. No.: 10/891,702

(22) Filed: Jul. 14, 2004

(65) Prior Publication Data

US 2005/0023158 A1 Feb. 3, 2005

Related U.S. Application Data

(60) Provisional application No. 60/529,210, filed on Dec. 12, 2003, provisional application No. 60/529,069, filed on Dec. 12, 2003, provisional application No. 60/493,848, filed on Aug. 8, 2003, provisional application No. 60/487,681, filed on Jul. 16, 2003.

(51) Int. Cl.
*B65D 85/10* (2006.01)

(52) U.S. Cl. ..... 206/256; 206/261; 206/265; 206/271

(58) Field of Classification Search ..... 206/256, 206/259, 271, 265, 242, 261, 251, 249, 250, 206/255; 229/87.13, 120.38, 120.15, 108; 220/4.21, 4.24

See application file for complete search history.

(56) References Cited

U.S. PATENT DOCUMENTS

| | | | | |
|---|---|---|---|---|
| 276,171 A | | 4/1883 | Fraser | |
| 1,108,005 A | * | 8/1914 | Rey | 206/256 |
| 2,984,340 A | | 5/1961 | Carmichael | |
| 3,007,623 A | | 11/1961 | Clemens | |
| 3,027,998 A | * | 4/1962 | Ridgway | 206/264 |
| 3,039,671 A | | 6/1962 | Chiamardas | |
| 3,148,768 A | | 9/1964 | Gatto | |
| 3,226,010 A | | 12/1965 | Rogers, Jr. | |
| 4,081,126 A | * | 3/1978 | Barnard | 206/256 |
| 4,784,261 A | | 11/1988 | Kutchin | |
| 5,158,178 A | * | 10/1992 | Cobler | 206/256 |
| 5,214,901 A | | 6/1993 | Milliner | |
| 5,251,748 A | * | 10/1993 | Adams et al. | 206/256 |
| 5,277,304 A | | 1/1994 | Brizzi et al. | |
| 5,344,008 A | | 9/1994 | DeBlasio et al. | |
| 5,435,439 A | * | 7/1995 | Swart | 206/249 |

(Continued)

FOREIGN PATENT DOCUMENTS

| | | |
|---|---|---|
| DE | 32 36 544 | 4/1984 |

(Continued)

*Primary Examiner*—Mickey Yu
*Assistant Examiner*—Steven A. Reynolds
(74) *Attorney, Agent, or Firm*—Connolly Bove Lodge & Hutz LLP

(57) ABSTRACT

A cigarette pack has a pair of complementary packets each having a box that includes a straight or angled or non-orthogonal side panel and wherein each box contains a group of cigarettes. The packets are arranged adjacent one another along their straight or non-orthogonal sides and then overwrapped to produce the cigarette pack. Each packet includes ten cigarettes for a total pack count of twenty cigarettes. The individual packets promote ease of transport and overall freshness. The packet may have rounded or beveled corners, and each packet may have a hinge lid or comprise an outer shell and interior cigarette holding slide.

7 Claims, 14 Drawing Sheets

U.S. PATENT DOCUMENTS

| | | | | |
|---|---|---|---|---|
| 5,473,862 | A | 12/1995 | Brizzi et al. | |
| 5,487,468 | A * | 1/1996 | Sheahan | 206/242 |
| 5,513,748 | A | 5/1996 | Focke et al. | |
| 5,699,903 | A | 12/1997 | Focke et al. | |
| D427,369 | S | 6/2000 | Bowen et al. | |
| 6,223,895 | B1 | 5/2001 | Bowen et al. | |
| 6,343,691 | B1 * | 2/2002 | Focke et al. | 206/268 |
| D462,805 | S | 9/2002 | Draghetti | |
| 6,779,658 | B2 * | 8/2004 | Polloni et al. | 206/268 |
| 2003/0010656 | A1 | 1/2003 | Focke et al. | |
| 2004/0031704 | A1 | 2/2004 | Amos | |

FOREIGN PATENT DOCUMENTS

| | | |
|---|---|---|
| DE | 93 08 941 | 2/1995 |
| DE | 200 07 497 | 9/2000 |
| FR | 2 069 643 | 9/1971 |

* cited by examiner

Fig. 1.
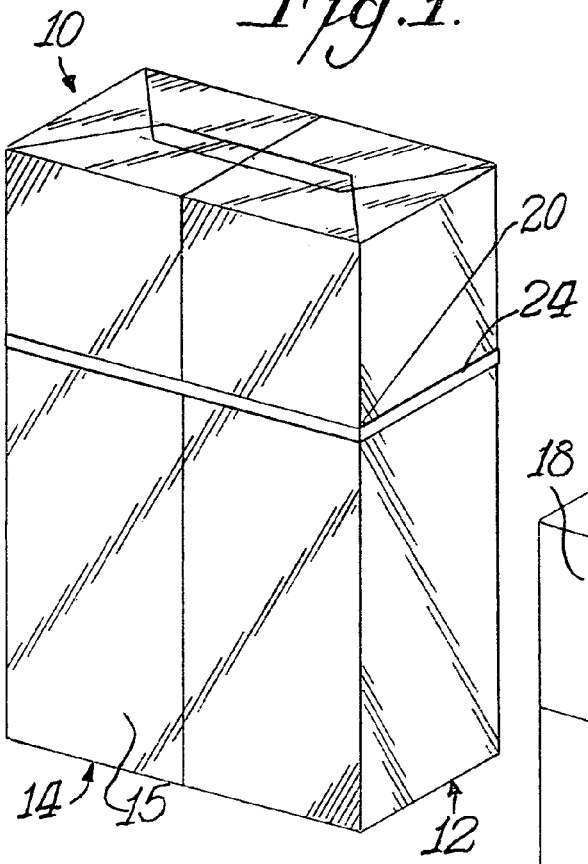
Fig. 3.
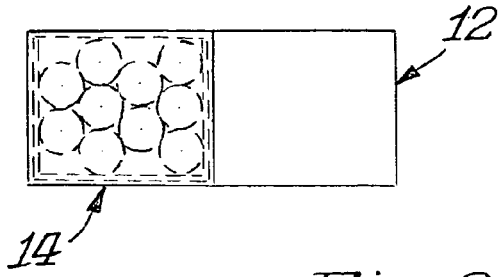
Fig. 2.
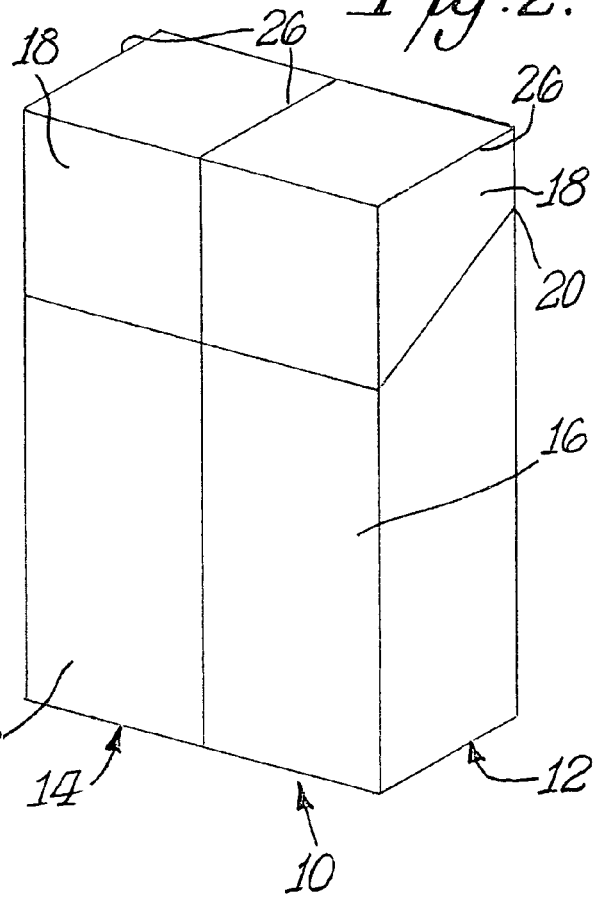
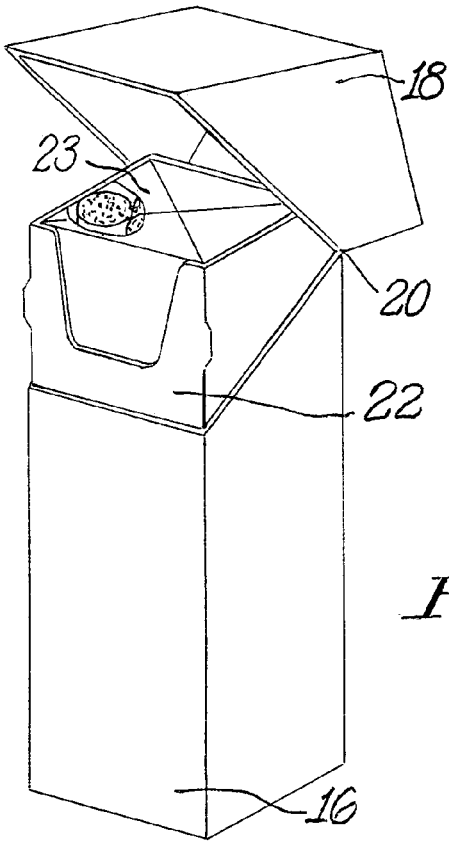
Fig. 4.

Fig. 13.
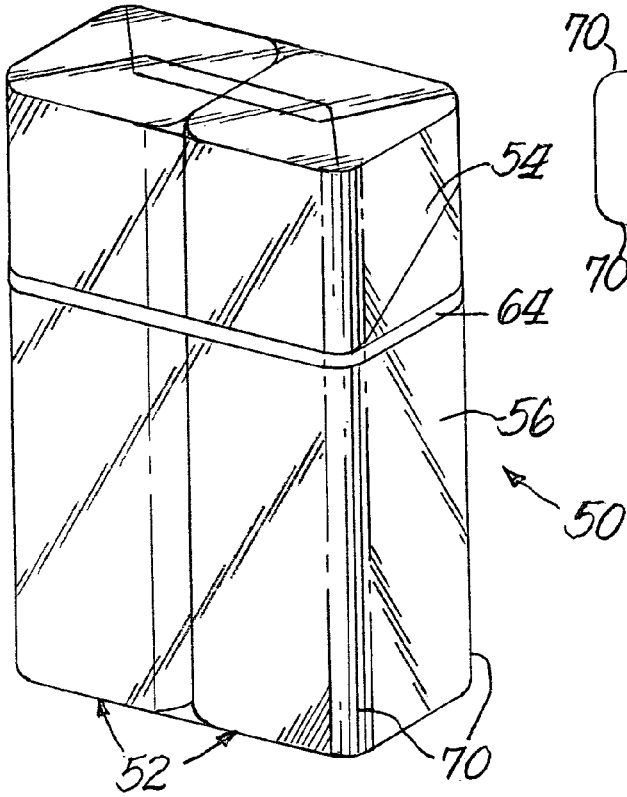
Fig. 14.
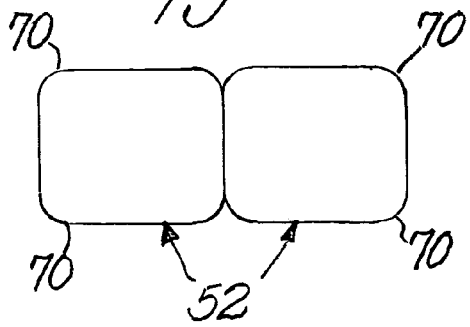
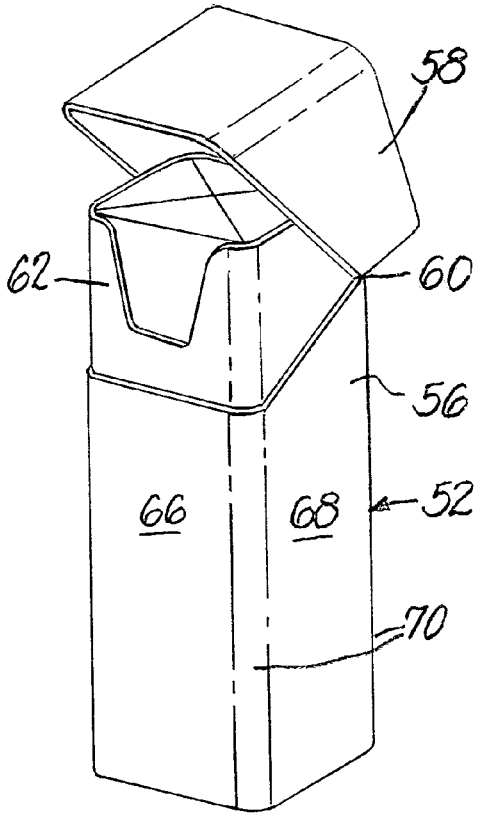
Fig. 15.

Fig. 19.
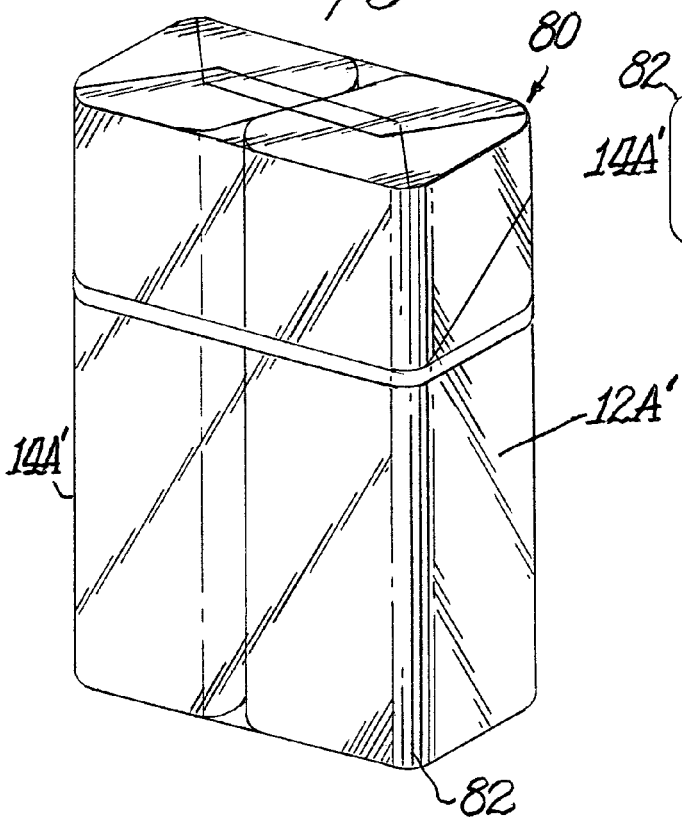
Fig. 20.
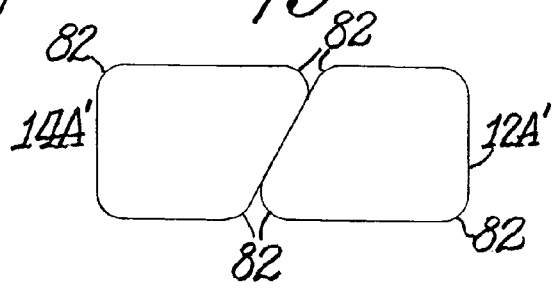
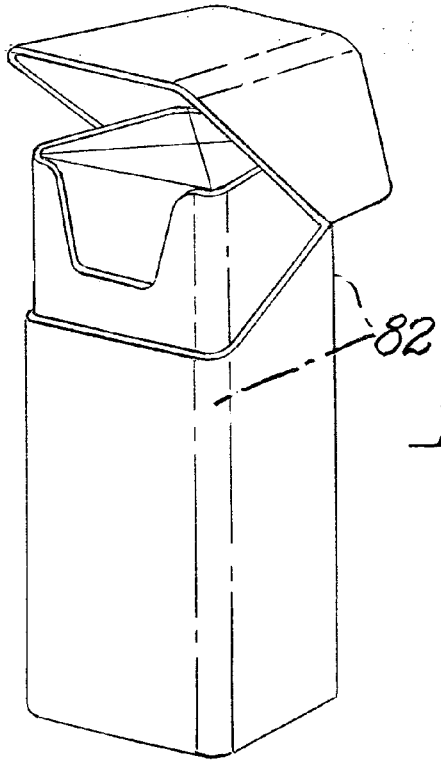
Fig. 21.

Fig. 25.
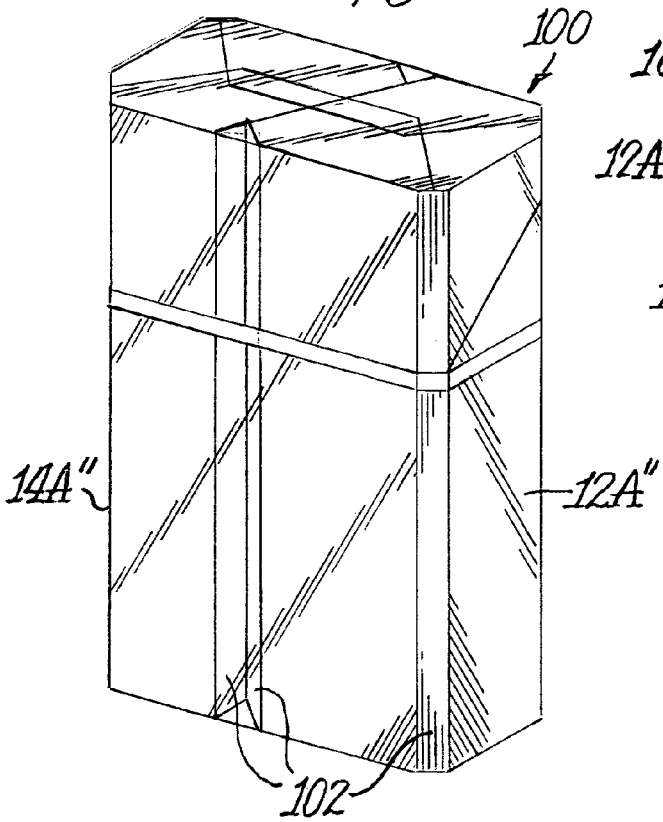
Fig. 26.
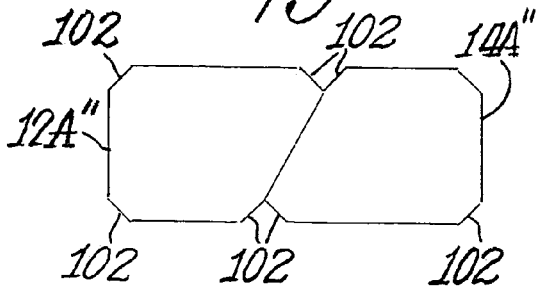
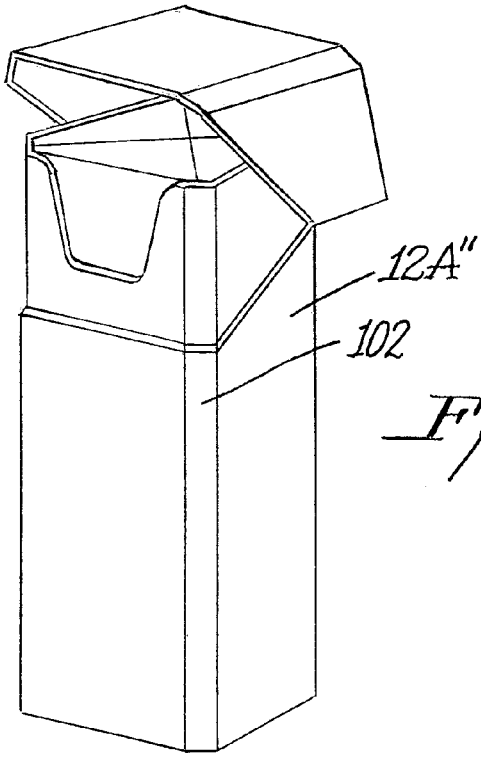
Fig. 27.

CIGARETTE PACK COMPRISING TWIN CIGARETTE PACKETS

CROSS REFERENCE TO RELATED APPLICATION

The present application relates to applications Ser. Nos. 60/487,681, filed Jul. 16, 2003, 60/493,848, filed Aug. 8, 2003, 60/529,069, filed Dec. 12, 2003, and 60/529,210, filed Dec. 12, 2003. All of these applications are incorporated herein in their entirety for all useful purposes, and the full benefit of all of these prior applications is claimed.

BACKGROUND OF THE INVENTION

The present invention relates to a cigarette pack that comprises twin cigarette packets, and more particularly to a cigarette pack where each of the two packets includes ten cigarettes for a total pack count of twenty cigarettes.

For the most part cigarettes are sold in packs with twenty cigarettes in each pack. In some instances it is desired to have smaller quantities of cigarettes for ease of transport and freshness.

SUMMARY OF THE INVENTION

In accordance with the present invention a cigarette pack comprises a pair of cigarette packets releaseably connected to one another for sale in pairs. Preferably, the overall dimensions of length, width and depth of each individual cigarette packet is such that when paired, the resultant overall dimensions of the formed pack are compatible with the dimensional requirements of state tax stamp machines and the associated carton recasing equipment, as well as those of point-of-sale displays and display racks at retail. The pair of packets are wrapped together and each packet may include ten cigarettes for a total of twenty cigarettes which is the minimum quantity allowed for sale in certain countries. This overall packet construction allows the consumer to carry only ten cigarettes in one of the packets after the initial purchase of twenty cigarettes. The smaller packet of ten cigarettes easily fits in small purses, pockets and the like.

One of the packets may be individually wrapped and then combined with a second packet both of which are then overwrapped with clear overwrap material. When the cigarette pack is then opened the separate overwrapped packet retains freshness until that packet is opened at a later time and the cigarettes are consumed.

Each cigarette packet of ten cigarettes may comprise a box having a hinge lid for access to the cigarettes. The box has an inner frame and a bundle of ten foil wrapped cigarettes is placed within the inner frame.

BRIEF DESCRIPTION OF THE DRAWINGS

Novel features and advantages of the present invention in addition to those mentioned above will be readily apparent to persons of ordinary skill in the art from a reading of the following detailed description in conjunction with the accompanying drawings wherein similar reference characters refer to similar parts and in which:

FIG. 1 is a perspective view of a cigarette pack comprising twin cigarette packets each with a hinge lid and with overwrap around the packets, according to the present invention;

FIG. 2 is a perspective view of the cigarette pack of FIG. 1 with the overwrap removed, according to the present invention;

FIG. 3 is a top plan view of the cigarette pack of FIG. 1 with the cigarettes in one of the packets in phantom outline;

FIG. 4 is a perspective view of one of the twin cigarette packets of FIG. 1 with the hinge lid in an open position, according to the present invention;

FIG. 13 is a perspective view of another embodiment of a cigarette pack comprising twin cigarette packets each with rounded corners and a hinge lid with overwrap around the packets, according to the present invention;

FIG. 14 is a top plan view of the cigarette pack of FIG. 13 before being overwrapped;

FIG. 15 is a perspective view of one of the twin cigarette packets of FIG. 13 with the hinge lid in an open position, according to the present invention;

FIG. 19 is a perspective view of still another embodiment of a cigarette pack comprising twin cigarette packets each with rounded corners and a hinge lid with overwrap around the packets, according to the present invention;

FIG. 20 is a top plan view of the cigarette pack of FIG. 19 before being overwrapped;

FIG. 21 is a perspective view of one of the twin cigarette packets of FIG. 19 with the hinge lid in an open position, according to the present invention;

FIG. 25 is a perspective view of still another embodiment of a cigarette pack comprising twin cigarette packets each with beveled corners and a hinge lid with overwrap around the packets, according to the present invention;

FIG. 26 is a top plan view of the cigarette pack of FIG. 25 before being overwrapped;

FIG. 27 is a perspective view of one of the twin cigarette packs of FIG. 25 with the hinge lid in an open position, according to the present invention;

DETAILED DESCRIPTION OF THE INVENTION

Figure 6:
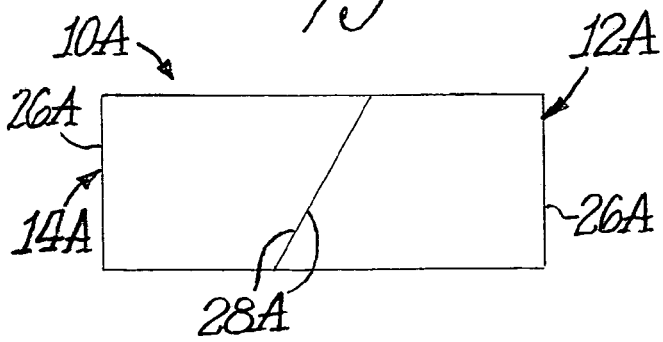
FIG. 6 is a top plan view of the cigarette pack shown in FIG. 5.

Referring in more particularity to the drawings, FIGS. 1-4 illustrate a cigarette pack 10 comprising twin cigarette packets 12, 14 both of which are overwrapped with clear cellophane 15 or similar wrap material, as well known. One of the packets is shown in FIG. 4. Fundamentally, each of the packets 12,14 comprises a box 16 with a hinge lid 18 that articulates about hinge line 20 in opening and closing the packet. An inner frame 22 is positioned in the container portion of each box. Preferably 10 cigarettes are wrapped in foil 23 or other suitable material and placed within the inner frame of each of the packets 12, 14. A tear strip 24 is used to remove to outer wrap 15, as is well known.

One of the packets may be wrapped with clear cellophane prior to being combined with the second packet. Both packets are then overwrapped with additional material. Once the cigarette pack 10 is opened the initially overwrapped packet remains sealed until consumption of the cigarettes in that packet are desired at a later time.

Figure 5:
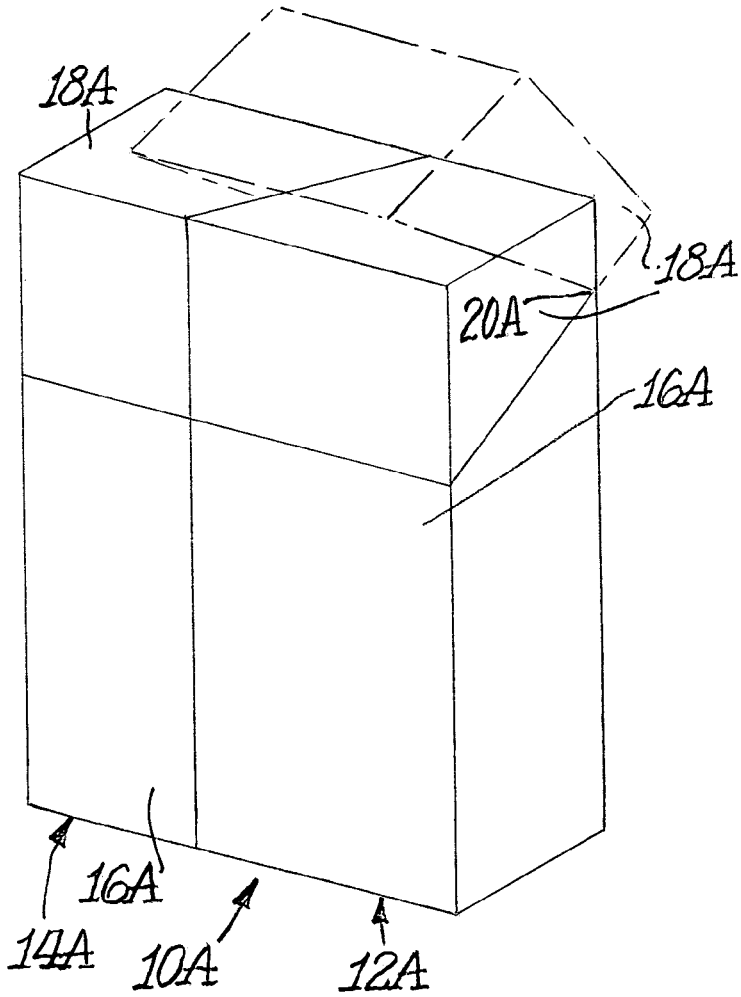
FIG. 5 is a perspective view similar to FIG. 2, but illustrating an alternate embodiment where each cigarette packet has an non-orthogonal panel, according to the present invention.

Unlike the packets 12, 14 which include straight side panels, FIGS. 5 and 6 illustrate an alternate embodiment where a cigarette pack 10A comprises twin packets 12A, 14A each having an orthogonal side panel 26A and a non-orthogonal side panel 28A. The non-orthogonal side panels 28A abut one another in the pack 10A, as shown in FIGS. 5 and 6. Each packet 12A, 14A comprises a box 16A with a hinge lid 18A that articulates about hinge line 20A in opening and closing the packet, as shown in phantom outline in FIG. 5. The hinge lid 18A has a top panel, opposite side panels, and front and rear panels. Each packet 12A, 14A has a trapezoidal configuration in cross section.

Figure 7:
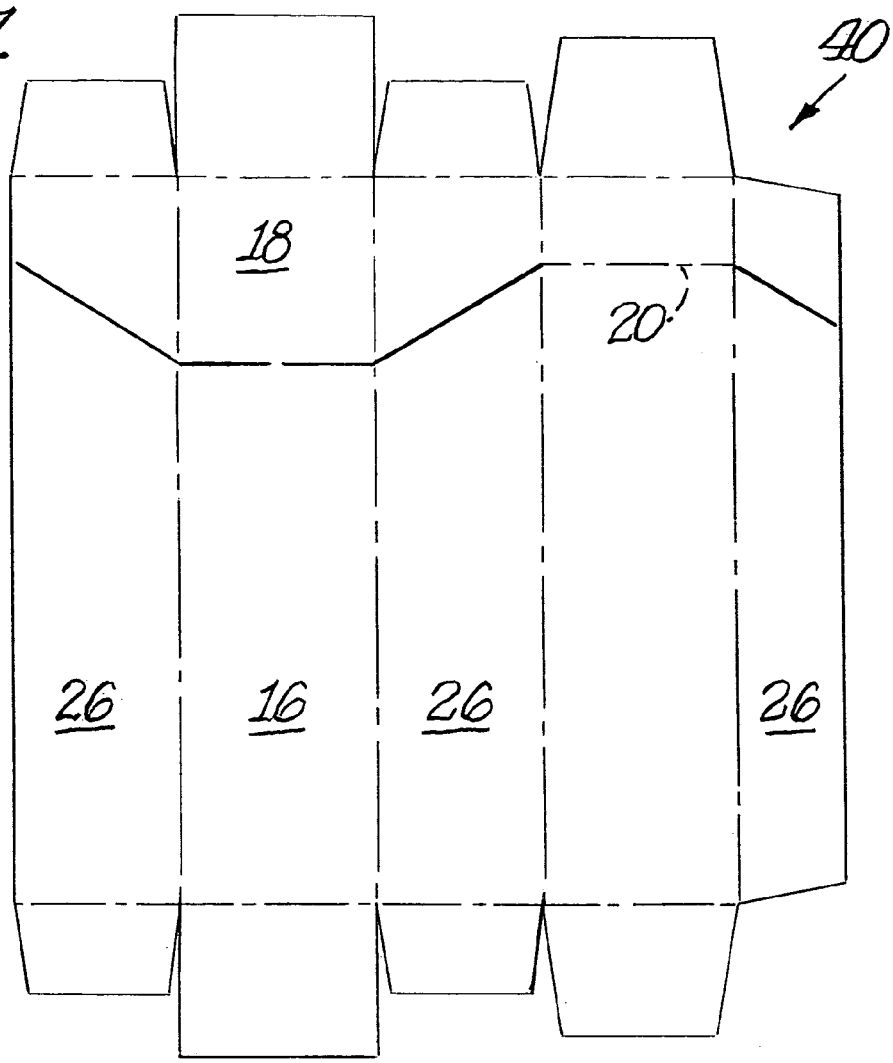
FIG. 7 is a top plan view of a blank for the cigarette packet shown in FIG. 4.
Figure 8:
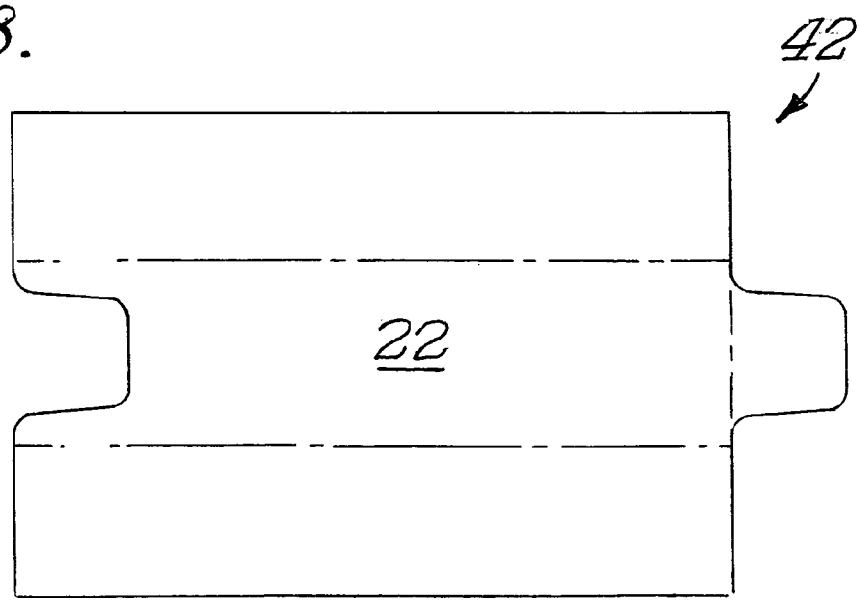
FIG. 8 is a top plan view of a blank for the inner frame of the packet shown in FIG. 4.
Figure 9:
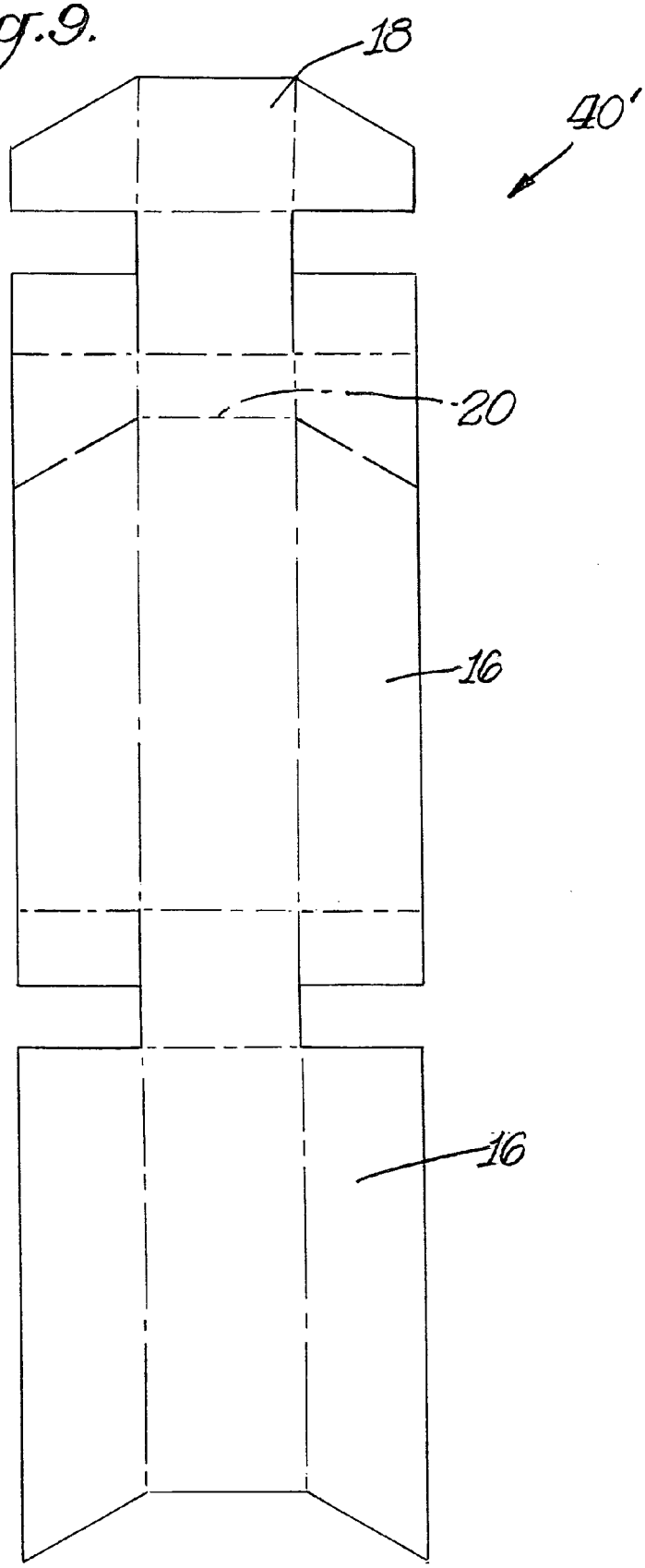
FIG. 9 is a top plan view of an alternate blank for the cigarette packet shown in FIG. 4.

FIG. 7 shows a blank 40 for producing one of the packets 12, 14 while FIG. 8 illustrates a blank 42 for producing the inner frame 22. Cut lines are shown as solid lines and fold lines are shown in phantom. The blanks are assembled and glued together as is well known in the art. Similarly, FIG. 9 shows an alternate blank 40' for producing one of the packets 12, 14. Here again cut lines are shown as solid lines while fold lines are shown in phantom. Blank 40' is different in that it has longitudinal fold lines for folding the blank in packet form. Once assembled, a blank 42 may be folded into the shape of the inner frame 22 and inserted into formed box portion 16.

Figure 10:
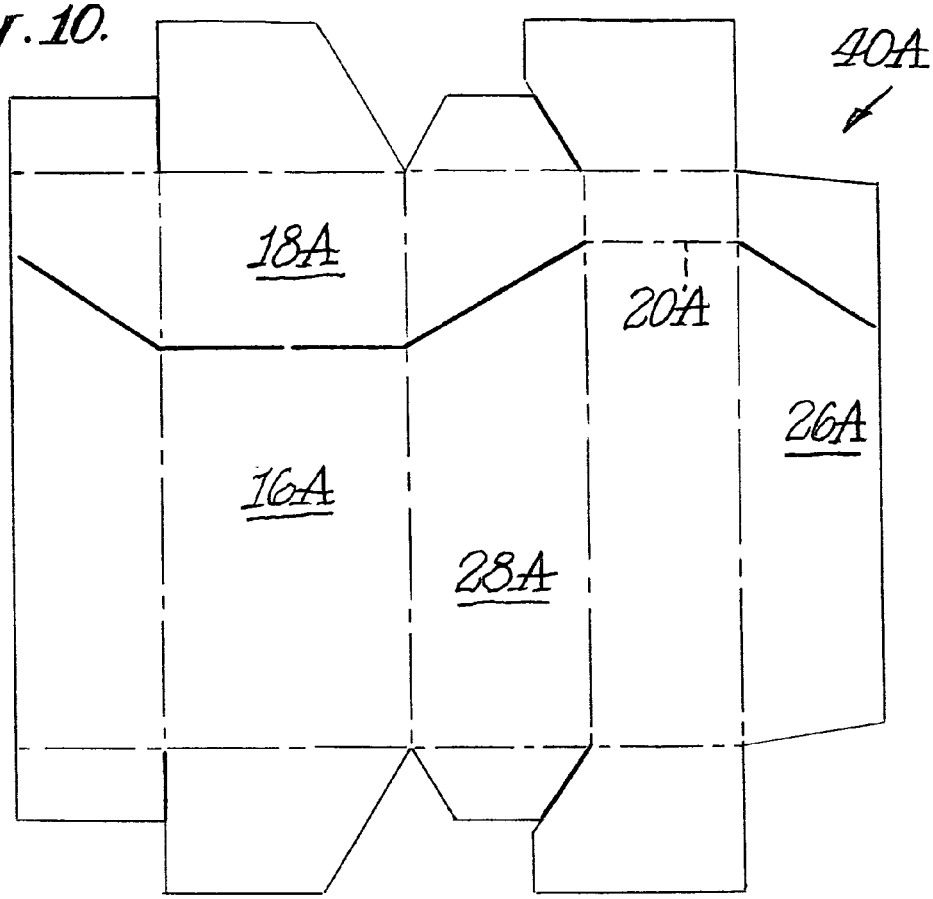
FIG. 10 is a top plan view of a blank for one of the cigarette packets shown in FIG. 5.

FIG. 9 shows a blank 40A for producing one of the packets 12A, 14A while FIG. 10 illustrates a blank 42A for producing the inner frame 22A. Here again, cut lines are shown as solid lines and fold lines are shown in phantom. Assembly is performed as is well known in the art.

Figure 12:
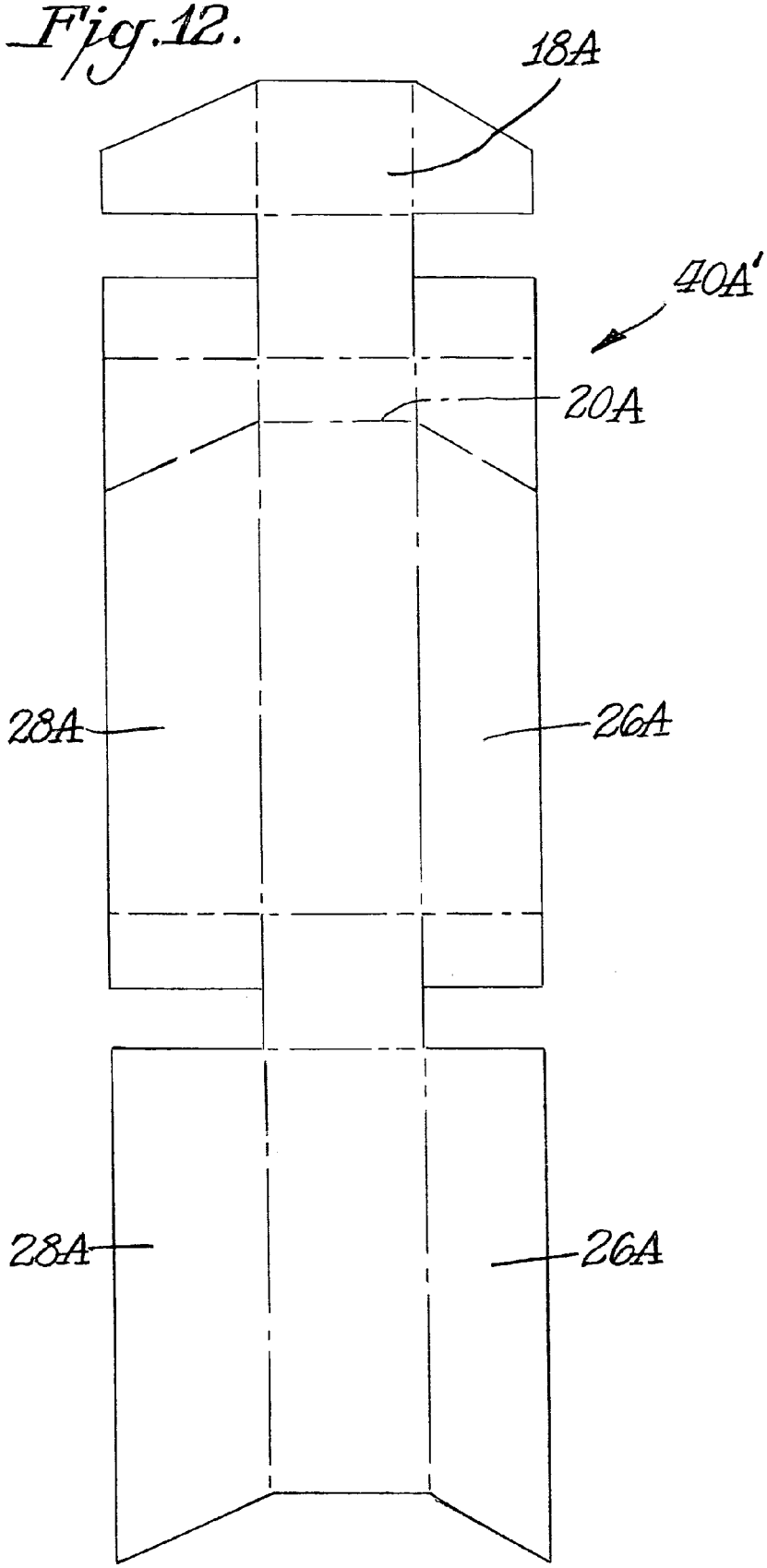
FIG. 12 is a top plan view of an alternate blank for the cigarette packet shown in FIG. 5.

FIG. 12 illustrates an alternative blank 40A' for producing one of the packets 12A, 14A. Cut lines are shown as solid lines while fold lines are shown in phantom. Blank 40A' is similar to blank 40' in that it includes longitudinal fold lines about which the blank is folded and glued into the shape of one of the packets 12A, 14A. Blank 40A' has panels 26A for forming the orthogonal side panel as well as panels 28A for forming the non-orthogonal panel of the packet 12A, 14A. A blank 42A may be used to form the inner frame 22A.

As noted above, the pack 10 comprises first and second packets 12, 14 releaseably wrapped or otherwise attached together so as to establish a complete twenty count (or more) pack of cigarettes, each packet preferably comprising a box 16 with a hinge lid 18. In pack 10A the orthogonal side panel 26A is perpendicular to the front and back panels of the box 16A while the opposite side panel 28A is angled. Preferably, the orthogonal side panel 26A is where the glue flap is secured or otherwise attached to form the packet.

Preferably, the packets are held together with a clear wrap such as a cellophane 15 or the like, or could be, in the alterative, held together with a wrap akin to a soft pack label that bears printed indicia, or in the alternative or in conjunction with the aforementioned, the packets are glued together with a releasable adhesive.

As noted above, one or both of the packets may be separately wrapped in cellophane or like material to preserve freshness of the contents of one or both packets. Another alternative is that neither packet is separately wrapped before the final wrap to cover the pair.

The complete twenty count pack accommodates a 7-6-7 collation of cigarettes, wherein a first one of the aforementioned packets may encloses a 4-3-3 collation or bundle of cigarettes (preferably wrapped in a cigarette bundle wrap constructed of paper and/or foil) and the other packet encloses a 3-3-4 bundled collation of cigarettes. The packets are in a mutually complementary orientation when joined along their angled or non-orthogonal panels 28A such that the complete pack 10A is of the usual rectangular box form.

As a paired unit, packs 10 and 10A correspond to a standard rectangular size and shape which allows for this product to be tax stamped in the US which is very critical for any new product to be feasible. It also will fit in vending machines, which for Japan, is very important as well. The two unit concept also allows for the possibility to offer two versions of a cigarette product, one in each of the two packets, such as full flavor and lights or menthol and a regular.

FIGS. 13-15 illustrate another cigarette pack 50 comprising identical cigarette packets 52 both of which are overwrapped with clear cellophane 54 or similar material. Fundamentally, each of the packets 52 comprises a box 56 with a hinge lid 58 that articulates about hinge line 60 in opening and closing the packet. An inner frame 62 is positioned inside each box 56. Preferably ten cigarettes are wrapped in foil 63 or other suitable material and placed within the inner frame of each packet 52. A tear strip 64 is used to remove the outer wrap 54, as is well known.

One of the packets 52 may be wrapped with clear cellophane prior to being combined with the second packet. Both packets are then wrapped with additional material 54. Once the cigarette pack 50 is opened the initially wrapped packet remains sealed until consumption of the cigarettes in that packet are desired at a later time.

Both the box 56 and hinge lid 58 include front and back panels 66 and interconnecting side panels 68. Each packet has rounded corners 70 wherein these panels adjoin one another as best shown in FIG. 14.

Figure 16:
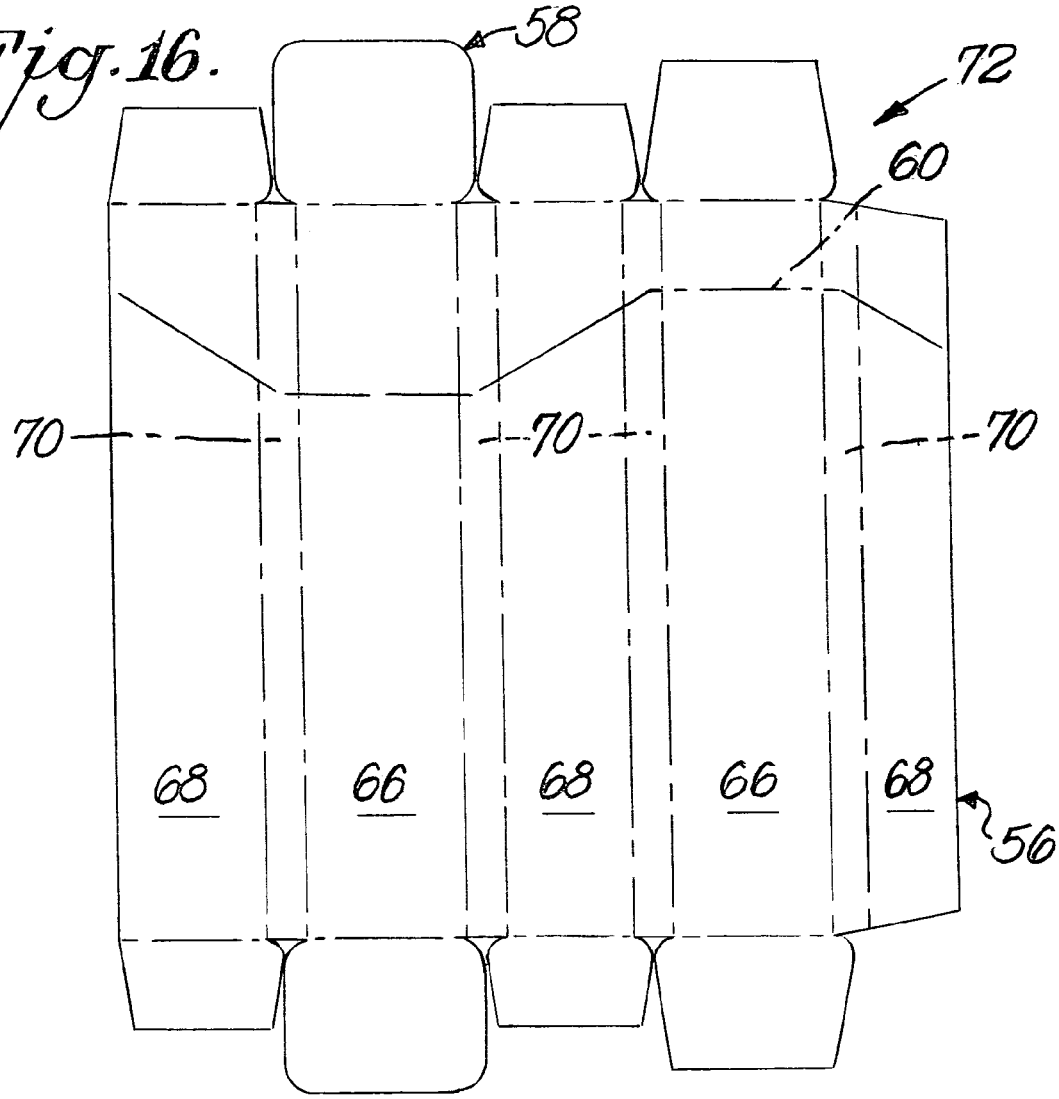
FIG. 16 is a top plan view of a blank for the cigarette packet shown in FIG. 15.
Figure 17:
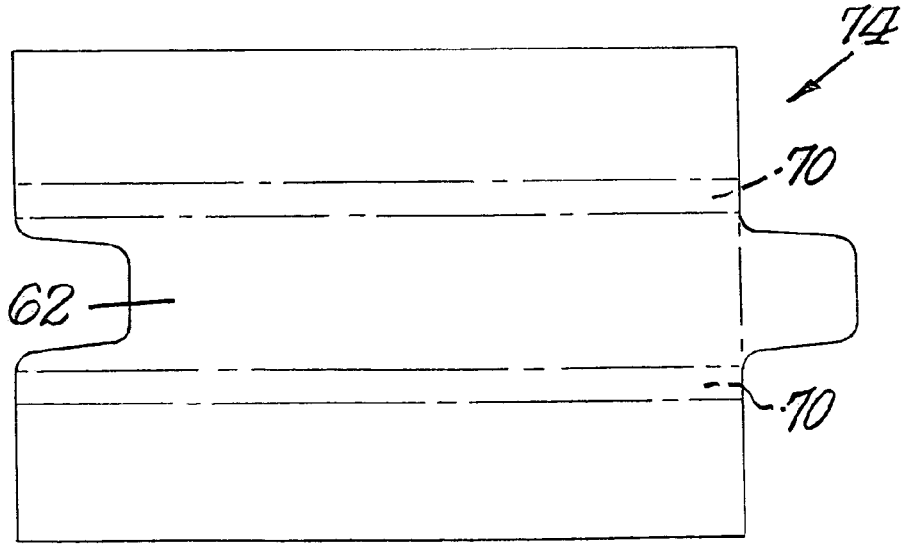
FIG. 17 is a top plan view of a blank for the inner frame of the packet shown in FIG. 15.

FIG. 16 shows a blank 72 similar in many respects to blank 40 of FIG. 7 for producing one of the packets 52 of cigarette pack 50. The significant difference is that blank 72 includes portions for producing the rounded corners 70. FIG. 17 shows a blank 74 for producing the inner frame 62. Blank 74 also includes portions for the rounded corners.

Figure 18:
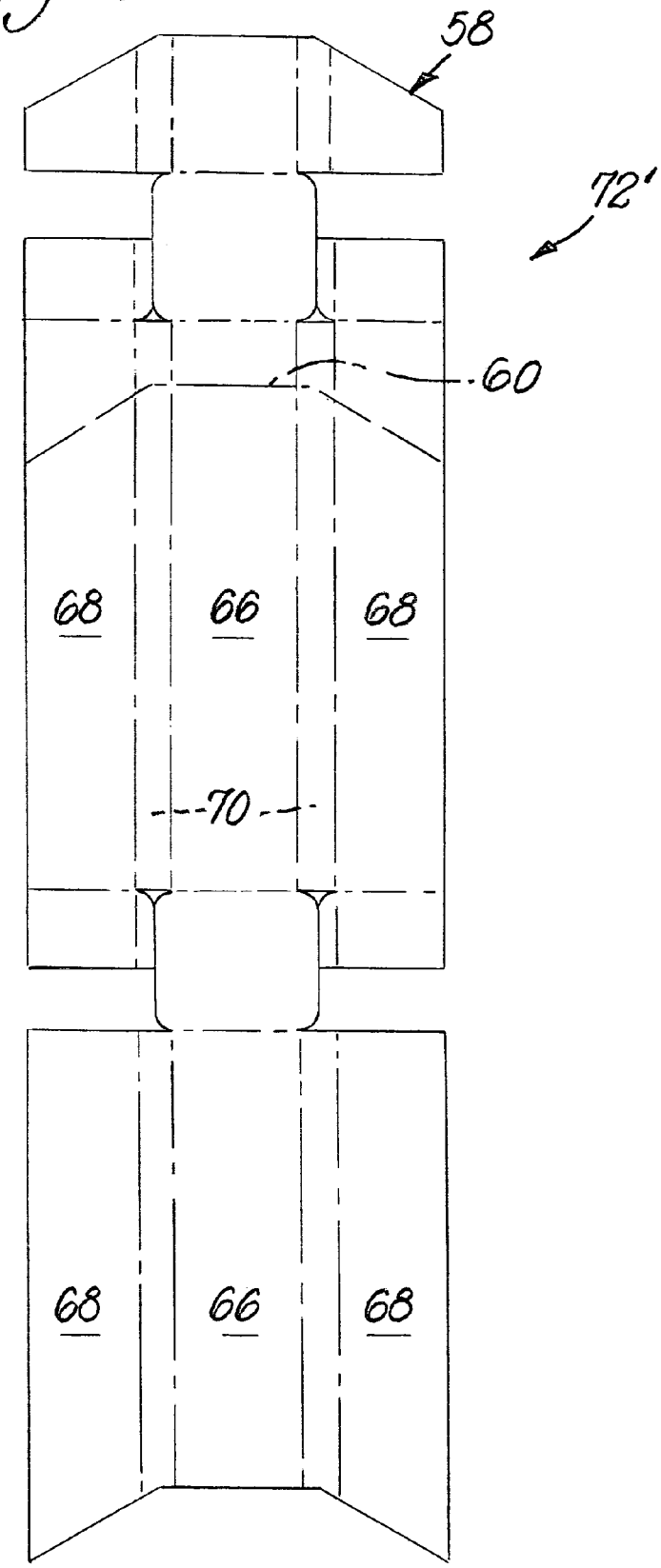
FIG. 18 is a top plan view of an alternate blank for the cigarette packet shown in FIG. 15.

FIG. 18 shows an alternate blank 72' similar in many respects to blank 40' of FIG. 9 for producing one of the packets 52 of cigarette pack 50. The main difference is that blank 72' includes portions for producing the rounded corners 70. A blank similar to blank 74 of FIG. 17 may be used in combination with blank 72' to form the packets 52.

Figure 11:
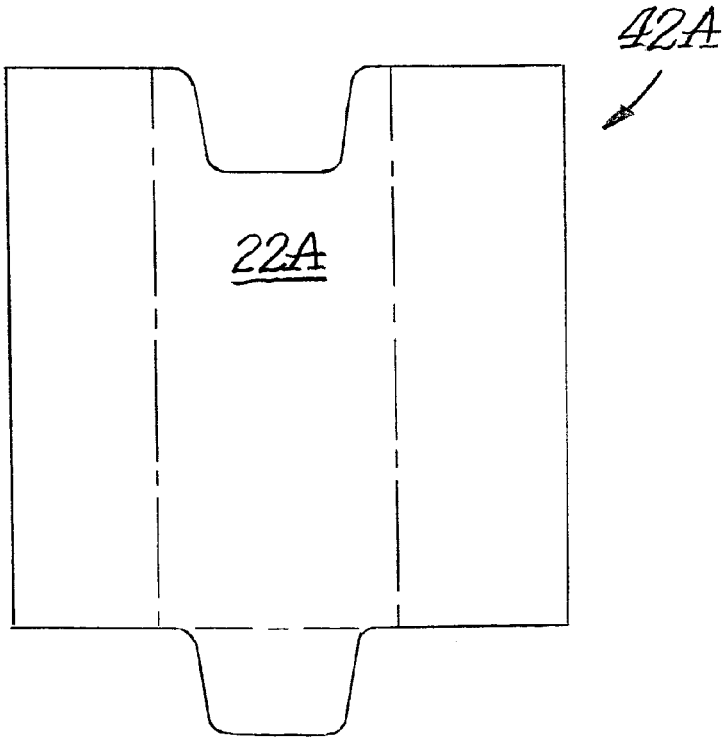
FIG. 11 is a top plan view of an inner frame for one of the cigarette packets shown in FIG. 5.

FIGS. 19-21 show another cigarette pack 80 similar in many respects to the pack 10A shown in FIGS. 5 and 6 and similar parts have been identified with the same reference characters. The major difference is that each packet 12A' and 14A' includes rounded corners 82. The blanks used to fabricate each packet are not specifically illustrated it being understood that the blanks shown in FIGS. 10-12 may be used if slightly modified to include rounded portions similar to those shown in FIGS. 16-18 for producing the rounded corners 82.

Figure 22:
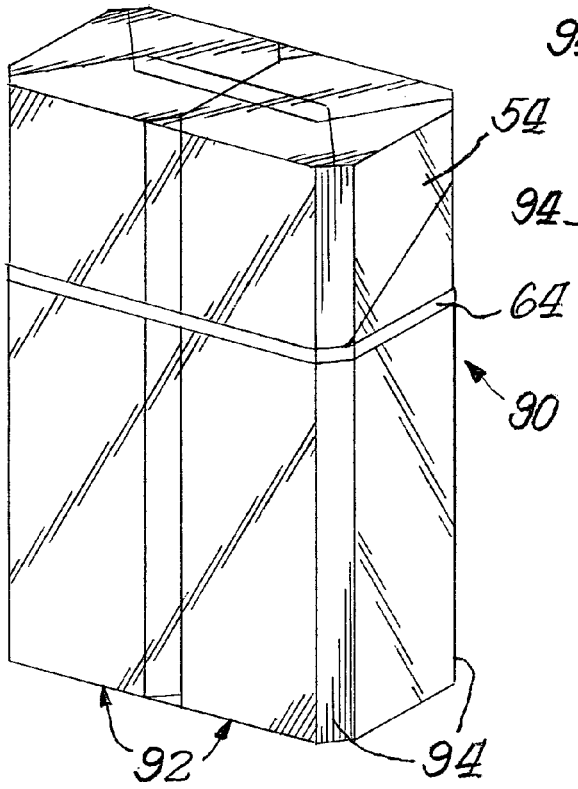
FIG. 22 is a perspective view of another embodiment of a cigarette pack comprising twin cigarette packets each with beveled corners and a hinge lid with overwrap around the packets, according to the present invention.
Figure 23:
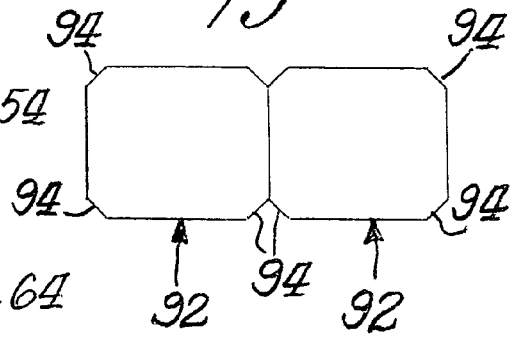
FIG. 23 is a top plan view of the cigarette pack of FIG. 22 before being overwrapped.
Figure 24:
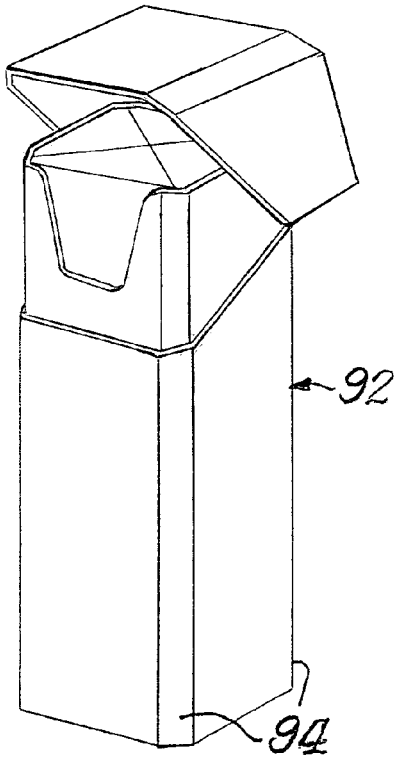
FIG. 24 is a perspective view of one of the cigarette packets of FIG. 22 with the hinge lid in an open position, according to the present invention.

FIGS. 22-24 illustrate another cigarette pack 90 comprising identical cigarette packets 92. Cigarette pack 80 is similar in many respects to pack 50 of FIGS. 13-15 and similar reference characters are used to identify similar parts. One significant difference is that each packet 92 includes beveled or angled corners 94 where the front, back and side panels of the box and hinge lid adjoin one another. As a result, the cross sectional configuration of each packet 92 is generally octagonal, as evident from FIG. 15.

FIGS. 25-27 illustrate still another cigarette pack 100 comprising cigarette packets 12A" and 14A". Cigarette pack 100 is similar to pack 80 of FIGS. 19-21 except that each packet 12A" and 14A" includes beveled or angled corners 102. Blanks not shown, but similar to the blanks shown in FIGS. 10-12 may be used if modified to include beveled or angled portions similar to those shown in FIGS. 16-18 for producing beveled corners 102.

Figure 28:
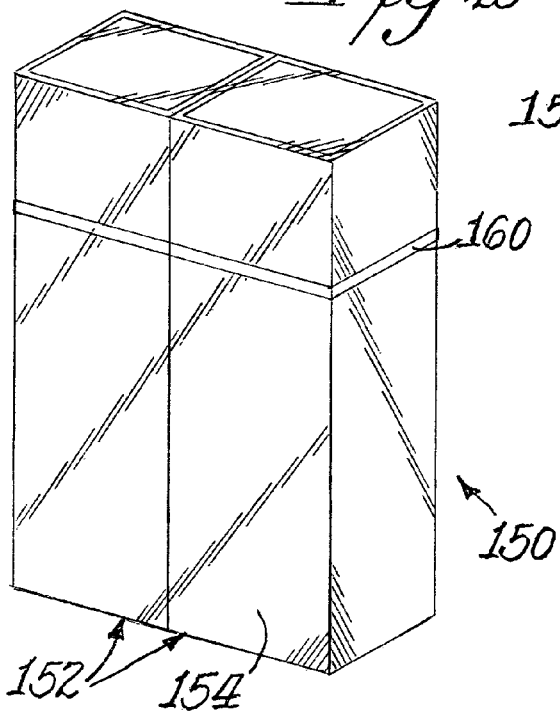
FIG. 28 is a perspective view of still another cigarette pack comprising twin cigarette packets with overwrap around the packets, according to the present invention.
Figure 29:
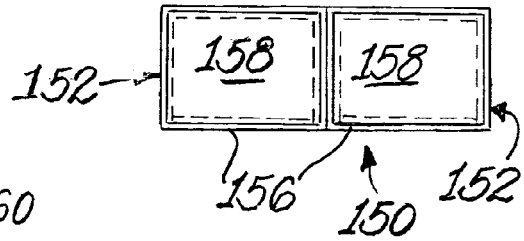
FIG. 29 is a top plan view of the cigarette pack of FIG. 28.
Figure 30:
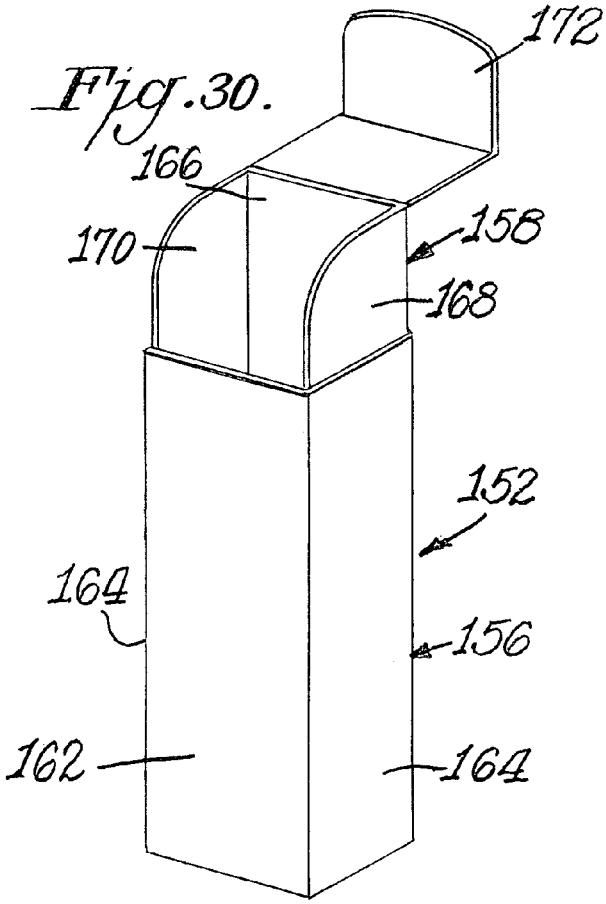
FIG. 30 is a perspective view of one of the twin cigarette packets of FIG. 28 in an open position, according to the present invention.

FIGS. 28-30 illustrate another cigarette pack 150 comprising twin cigarette packets 152 both of which are identical in structure with orthogonal panels. Clear cellophane or similar wrap material 154 functions to overwrap the cigarette packets 152. Fundamentally, each of the packets 152 includes an outer enclosure 156 with opposite open ends and an inner frame 158, as best shown in FIG. 30. Each packet 152 basically comprises a shell and slide arrangement where the open ended enclosure 156 comprises the shell and the inner frame 158 functions as a slide within the shell. Preferably, ten cigarettes are wrapped in foil or other suitable material and enclosed within each of the packets 152. A tear strip 160 may be used to remove the outer wrap 154 as is well known.

One of the packets 152 may be wrapped with clear cellophane prior to being combined with the second packet. Both packets are then overwrapped with additional material 154. Once the cigarette pack 150 is opened the initially overwrapped packet remains sealed until consumption of the cigarettes in that packet are desired at a later time.

The enclosure 156 includes identical front and back panels 162 and opposing identical side panels 164. When viewed in cross section each packet 152 has a generally square to rectangular orthogonal configuration, as shown in FIG. 29. The inner frame 158 includes a back panel 166 with adjacent side panels 168, 170, and a closure flap 172 extends along the back panel 66 as shown in FIG. 30.

Figure 31:
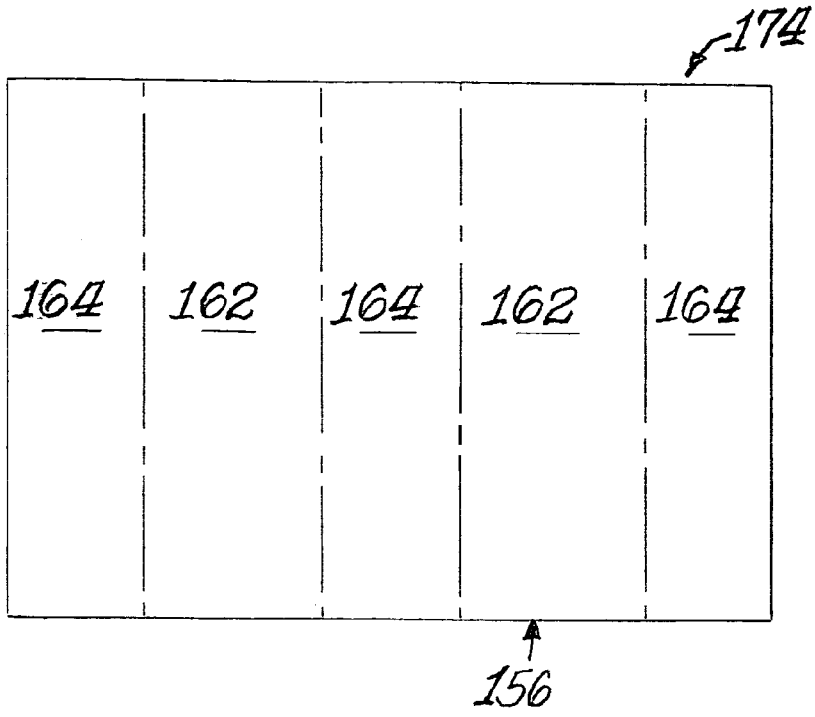
FIG. 31 is a top plan view of a blank for the outer enclosure or shell of one of the twin packets of the cigarette pack of FIG. 28.

FIG. 31 shows a blank 174 for the enclosure 156. The blank is simply assembled by folding along the fold lines of adjacent panels and the end side panels 164 are secured together with adhesive.

Figure 32:
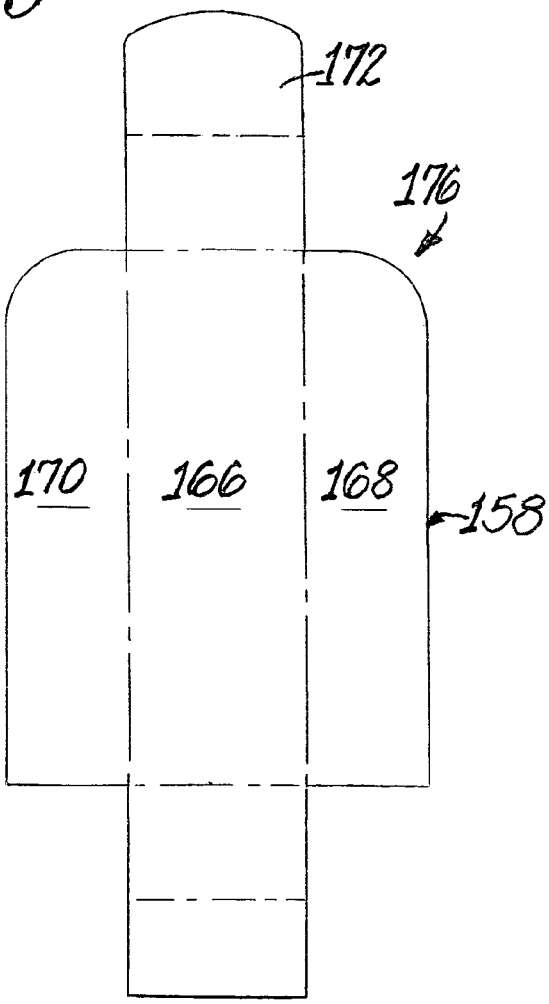
FIG. 32 is a top plan view of a blank for the inner frame or slide of one of the twin packets of the cigarette pack of FIG. 28.

FIG. 32 is a blank 176 for the inner frame 158. The blank is folded along the fold lines and then inserted into the enclosure to form one of the packets 152.

The shell and slide cigarette pack 150 shown in FIG. 28 and the individual cigarette packets 152 may also be formed with various shapes and sizes similar to the alternative embodiments of the hinge lid packets. For example, each individual shell and slide packet may include an orthoganal side panel and an opposite non-orthoganol side panel similar to the embodiment shown in FIGS. 5 and 6 with the non-orthoganal panels abutting one another to form a cigarette pack. Additionally, the vertical corners may be rounded or beveled in the same manner as shown in FIGS. 19-21 and FIGS. 25-27, for example.

Also, the shell and slide packets 152 specifically shown in FIGS. 28-30 may have rounded or beveled vertical corners similar to the corners shown in FIGS. 13-15 and FIGS. 22-24.

What is claimed is:

1. A cigarette pack comprising separate and individual first and second complementary packets, each packet having an orthogonal side panel and an opposite non-orthogonal side panel lying in a single plane with respect to the non-orthogonal side panel of the opposing packet, and the packets being releaseably joined together along their non-orthogonal panels so as to establish a single cigarette pack with two individual packets, and each packet having a trapezoidal configuration in cross-section, and wherein each packet includes ten cigarettes for a total pack count of twenty cigarettes.

2. A cigarette pack comprising separate and individual first and second complementary packets, each packet having an orthogonal side panel and an opposite non-orthogonal side panel lying in a single plane with respect to the non-orthogonal side panel of the opposing packet, and the packets being releaseably joined together along their non-orthogonal panels so as to establish a single cigarette pack with two individual packets, and each packet having a trapezoidal configuration in cross-section, and wherein each packet includes a hinge lid having a top panel, a front panel and opposite side panels.

3. A cigarette pack comprising first and second packets releaseably wrapped attached together so as to establish a complete 20 count pack of cigarettes with 10 cigarettes in each packet, each packet comprising a box with a hinge lid, and the box having a front panel, a back panel, an orthogonal side panel perpendicular to the front panel and back panel, and an angled side panel, and the box having a trapezoidal configuration in cross-section.

4. A cigarette pack as in claim 3 wherein a complete 20 count pack accommodates a 7-6-7 collation of cigarettes, and wherein a first one of the aforementioned packets encloses a 4-3-3 collation wrapped in a paper or foil cigarette bundle wrap and the other encloses a complementary 3-3-4 bundled collation of cigarettes.

5. A method of manufacturing a cigarette pack comprising complementary packets each including ten cigarettes for a total pack count of twenty cigarettes, each packet comprising a box and lid and having a non-orthogonal panel lying in a single plane, wherein each complementary packet is constructed from a similarly shaped blank with substantially the same folding and gluing mechanisms employed to form at least one procession of packets of a common orientation.

6. The method of claim 5 wherein the members of the procession are paired and one of the paired members is flipped to a complementary orientation, whereupon they are joined along the non-orthogonal panels.

7. The method of claim 5 wherein the members of the procession are paired with packets of a second procession of a complementary orientation, whereupon they are joined along the non-orthogonal panels.

* * * * *